United States Patent [19]

Mullen et al.

[11] 4,041,863

[45] Aug. 16, 1977

[54] PRECISION HAND LABEL IMPRINTER AND DISPENSER

[75] Inventors: James W. Mullen, Moraga; Boone K. McReynolds, Concord; Herbert D. Pace, Pleasanton, all of Calif.

[73] Assignee: Vidac Corporation, Concord, Calif.

[21] Appl. No.: 596,948

[22] Filed: July 18, 1975

[51] Int. Cl.[2] ..... B41F 3/20; B41J 33/12; B41K 3/58

[52] U.S. Cl. ..... 101/269; 101/56; 101/66; 101/100; 101/107; 101/110; 101/273; 101/274; 101/288; 197/151

[58] Field of Search ..... 101/66, 45, 72, 100, 101/107, 110, 269, 287, 56, 288, 96, 273, 102, 55, 274; 197/151

[56] References Cited

U.S. PATENT DOCUMENTS

| | | | |
|---|---|---|---|
| 2,703,017 | 3/1955 | Smith | 101/269 |
| 3,330,207 | 7/1967 | DeMan | 101/288 |
| 3,482,512 | 12/1969 | Jung | 101/110 |
| 3,656,430 | 4/1972 | Olsson | 101/288 |
| 3,738,263 | 6/1973 | Combs et al. | 101/96 |
| 3,798,106 | 3/1974 | Jenkins et al. | 101/316 |
| 3,804,227 | 4/1974 | Cappotto et al. | 197/151 |
| 3,814,015 | 6/1974 | Ozaki et al. | 101/269 |
| 3,828,667 | 8/1974 | Davis et al. | 101/66 |
| 3,838,640 | 10/1974 | Correll et al. | 101/269 |
| 3,859,509 | 1/1975 | Dillingham et al. | 101/269 |
| 3,862,598 | 1/1975 | Hawthorne | 101/269 |
| 3,880,078 | 4/1975 | Pelet | 101/288 |
| 3,893,393 | 7/1975 | See | 101/269 |

OTHER PUBLICATIONS

Cole et al., "*U.P.C. Printer*" IBM Technical Disclosure Bulletin, vol. 17, No. 5, p. 1451, Oct. 1974.

*Primary Examiner*—Ernest T. Wright, Jr.
*Assistant Examiner*—William Pieprz
*Attorney, Agent, or Firm*—Joseph L. Strabala

[57] ABSTRACT

A precision hand-held label imprinter and dispenser includes a compact case or frame with a projecting handle and an applicator roller located remote therefrom, together with a dialable imprinter and platen assembly arranged so that a trigger lever associated with the handle may be manually acutated in one direction to imprint label stock (tape) by driving the platen across an imprinter in an engaged condition to force the printing medium and label stock thereagainst and operates in the opposite direction to separate the imprinter and platen and to simultaneously advance the printing medium and to advance the printed label stock to the applicator roller. Through a series of connected drive elements with the trigger lever, the device times the several functions so that accurate reproductions with high resolution of the dialed imprint information on each label is assured. A specially constructed imprinter sub-assembly achieves the high print resolution on the labels with a plurality of large diameter print wheels supported on a large diameter print shaft to minimize deflection of the imprinted data during the label printing operation. In addition, a special label and printing medium feed wherein the printing medium is fed transversely to the label stock avoids smudges and deterioration of the printed label subsequent to its printing. Further, a special internal gearing arrangement with the print wheels allows the data to be spaced compactly without the loss of the facility to change the imprinted information through a simple dialing arrangement.

18 Claims, 11 Drawing Figures

FIG. 4.
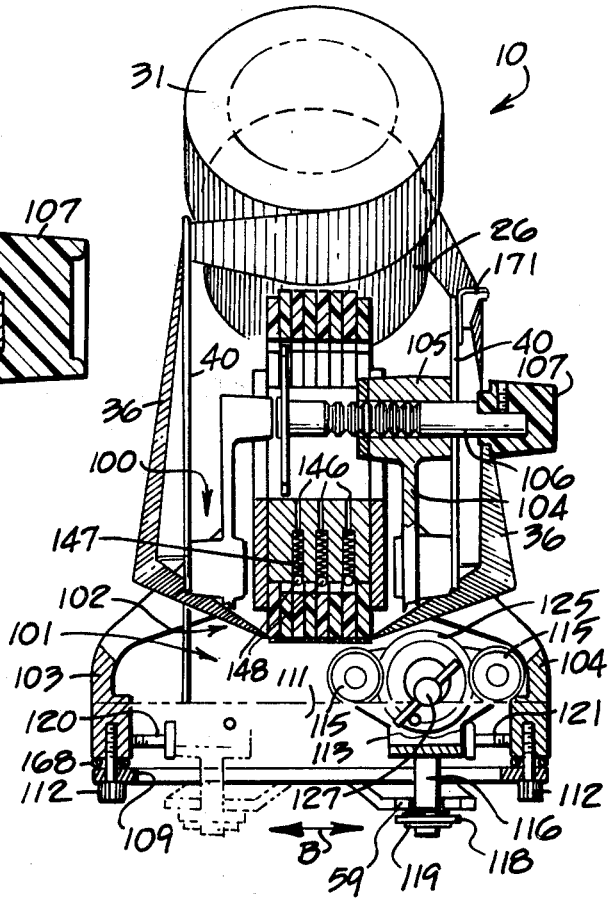
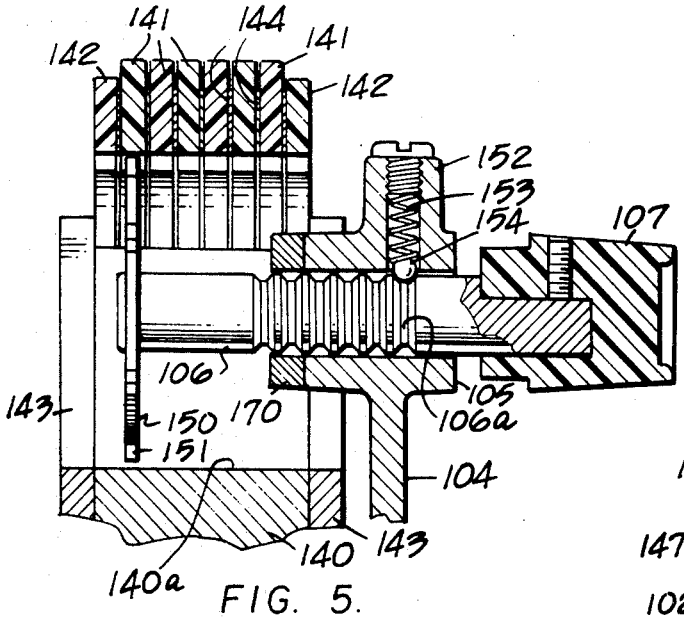
FIG. 5.
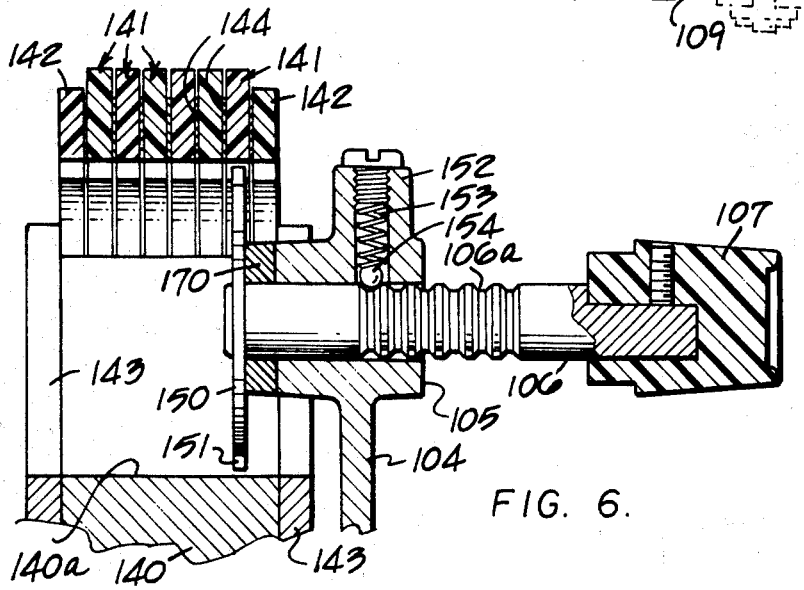
FIG. 6.

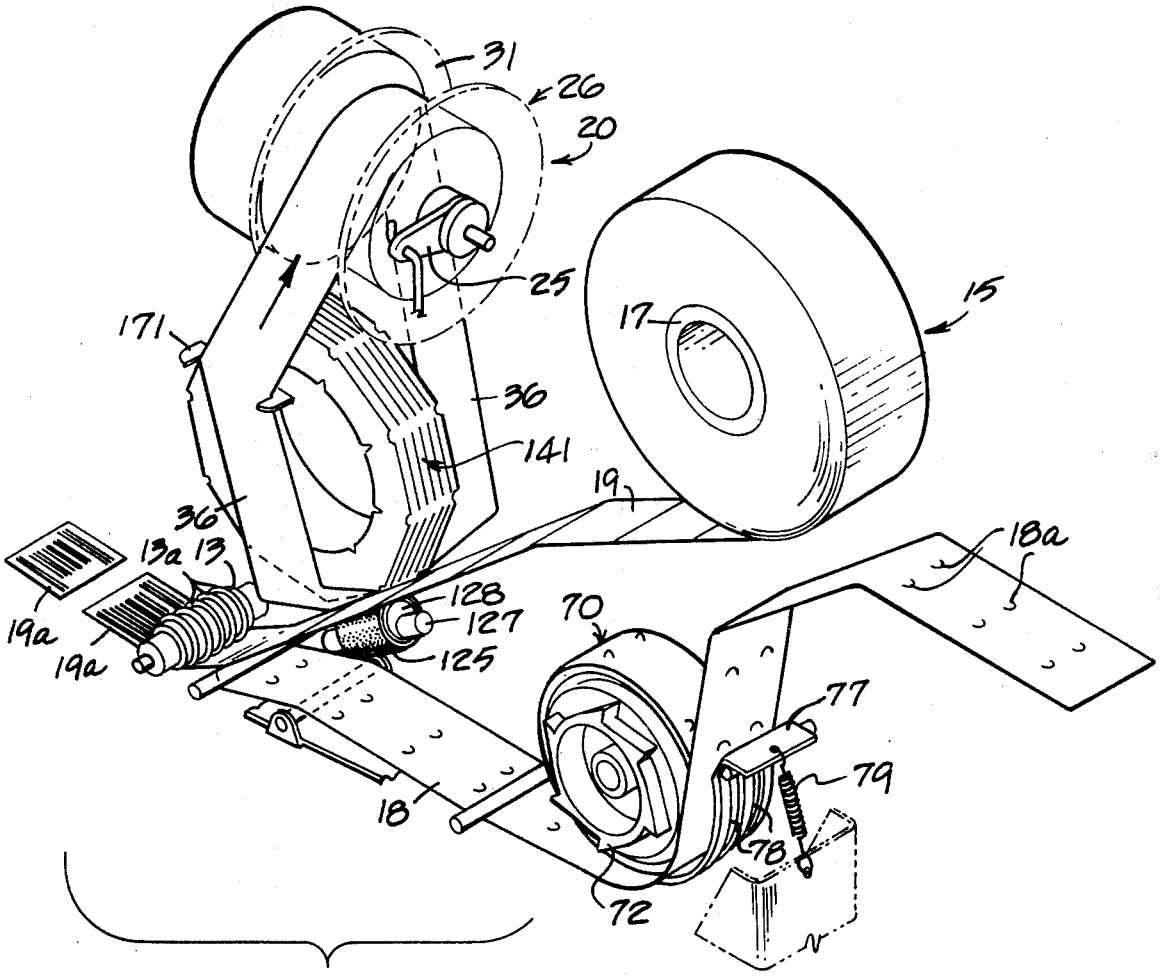
FIG. 7.
FIG. 8.
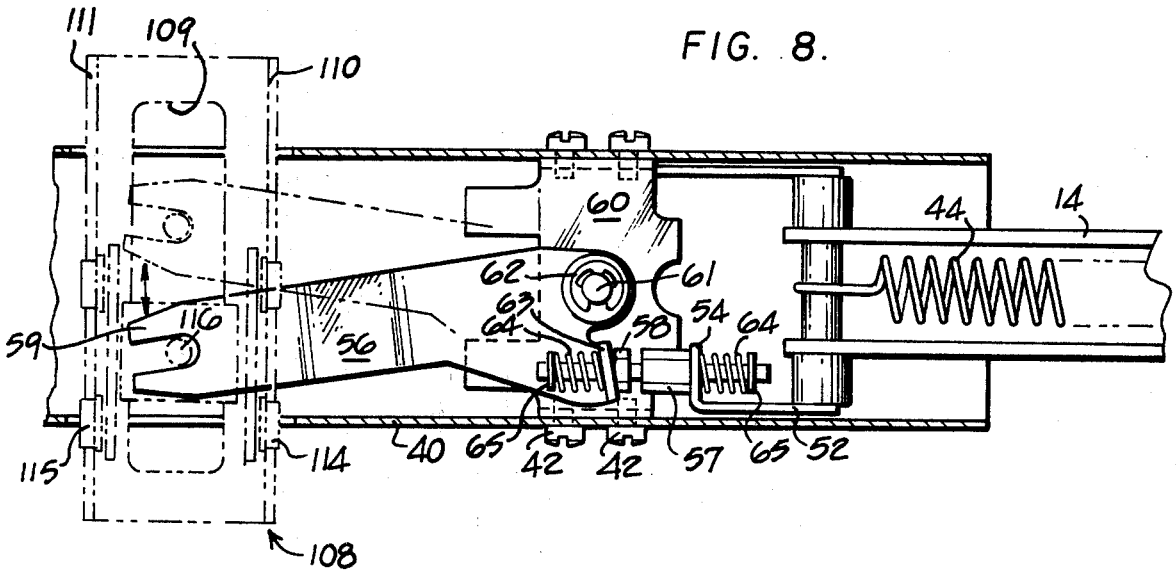

PRECISION HAND LABEL IMPRINTER AND DISPENSER

BACKGROUND OF THE INVENTION

Many articles sold in commerce, by law or for other compelling reasons, are now marked with various indicia. Such information as the manufacturer, the production run, the producing plant, price information and the like are typical of the types of information which are now often marked on such articles in a coded form. As a result, special techniques have been devised to convey such information or data in a highly densified form. One such data form is the Universal Product Code (UPC) which consists of a series of parallel bars in one or more fields, depending on the particular version of the code, which can be read optically with sensing devices, such as laser scanners. Usually these codes also include printed numerals at one end of the bars through which the encoded information is displayed.

For the UPC-type codes or similar codes to be machine readable, the printing of the code must be done in a manner that relatively high resolution of the printed information is obtained. Further, such information must be printed to certain specifications in order for the laser scanner or other similar device to read the information into a computer.

For example, the coded information of the UPC can vary infinitely in size without effecting the degree to which it can be read by a scanning device, so long as certain relative relationships are maintained between the several characters in the code. Further, the format can be square or varied in numerous ways so long as a straight line scanning path across the code can be achieved.

More specifically with reference to the UPC, each character in its code is composed of seven modules (two bars and two spaces). If the module width is 0.010 inches, the bar or space tolerance within each character is plus or minus 0.001 inches, the edge-to-edge tolerance within the character is plus or minus 0.00147 inches, and the character-to-character tolerance is plus or minus 0.00290 inches. Alternatively, if the module width is 0.025 inches, these tolerances are respectively plus or minus 0.00958 inches, plus or minus 0.00367 inches and plus or minus 0.00725 inches. See "UPC Symbol Specification" January, 1975, published by Distribution Codes, Inc., 401 Wythe St., Alexandria, Va.

Obviously, these specifications are difficult to maintain in a hand-held and -operated label generating device, especially due to the limited character-to-character tolerances. It is even more difficult to maintain these specifications when the hand-held unit includes the flexibility to dial and print labels having optionally selected codes.

As a result, some hand-held label generating devices, such as illustrated in U.S. Pat. No. 3,880,078 issued to Pelet, have used other codes to avoid the relatively strict specifications of the UPC. While the specifications for labels conforming with the UPC specifications can be printed with large console-type units or with conventional printing equipment, it is difficult to achieve the necessary resolution and tolerances in lightweight hand-held and hand-operated label printing devices such as shown in U.S. Pat. No. 3,674,609 issued to Schrotz et al or the above U.S. Pat. No. 3,880,078 issued to Pelet.

This invention relates to a hand-held and hand-operated label device capable of generating labels to the specifications of the UPC which includes the capability of changing the imprinted data on successive labels.

Another object of the instant invention is the provision of a unitized imprinter and platen assembly that ensures data imprinting with high resolution on successive labels in a portable imprinting unit.

A still further object of the instant invention is the provision of an imprinter and platen assembly capable of printing highly densified data, along with the ability to dial different data into the imprinting surface.

A still further object is the provision of a hand-held label imprinter device which employs a single lever operator to eliminate errors when the device is in use.

Another object of the instant invention is a small lightweight portable unit capable of generating printed data having high resolution and which can be easily loaded with label stock and printing medium to produce high resolution labels.

Of course, a general feature of the instant invention is the provision of a precision portable hand-operated label generating unit which will allow the production of locally-generated labels conforming to the UPC specifications at all levels of product distribution.

SUMMARY OF THE INVENTION

The above objects and advantages are accomplished by a lightweight hand-held label generating device which includes a case or frame with a handle mounted therein and an applicator roller opposite the handle and an actuator lever associated with the handle to operate its mechanisms, the latter of which includes an imprinter assembly with a platen, a platen drive, a label feed and printing medium feed which are positively linked to the actuator lever so the imprinting of the labels occurs when the lever is merged with the handle and the imprinter and platen are separated while the printed labels are advanced to the applicator roller simultaneously with the advance of the printing medium when the lever returns to its ready position, whereby the mechanism is ready to print a subsequent label. A special printing medium feed is employed which is transverse to the label feed, as well as a special imprinter assembly that employs large diameter print wheels on a large diameter print shaft with internal adjusting means, whereby high resolution imprinting can be achieved with minimum clearances between the adjacent changeable characters or fonts without losing the ability to dial the desired characters.

BRIEF DESCRIPTION OF THE DRAWINGS

The hand-held imprinter will be better understood by reference to the attached drawings in conjunction with the written description which illustrates a preferred embodiment wherein:

FIG. 4 is a section of the imprinter along line IV—IV of FIG. 3 better detailing the imprinter sub-assembly;

FIG. 5 is an enlarged broken-away portion of FIG. 4 better illustrating the dialing arrangement for changing the characters or fonts to be imprinted on the labels;

FIG. 6 is a duplicate of FIG. 5 with the dialing knob extracted to independently adjust a different print wheel;

FIG. 7 is a schematic in perspective showing the threading relationships of the printing medium, the label stock and the backing tape of the label stock in the imprinter;

FIG. 8 is a cross section of the imprinter with parts broken away and some in phantom showing details of the platen drive;

BRIEF DESCRIPTION OF THE PREFERRED EMBODIMENT

Figure 1:
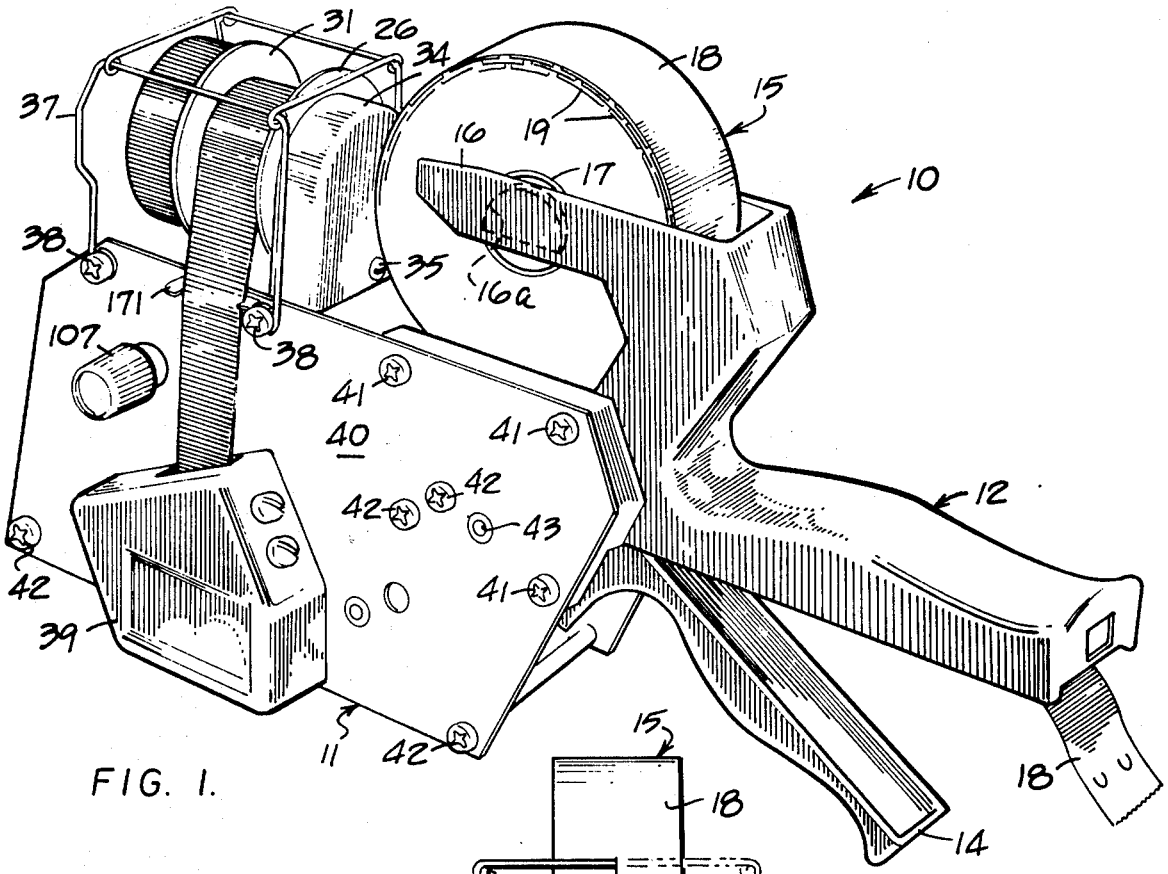
FIG. 1 is a perspective of the imprinter from one side thereof.
Figure 2:
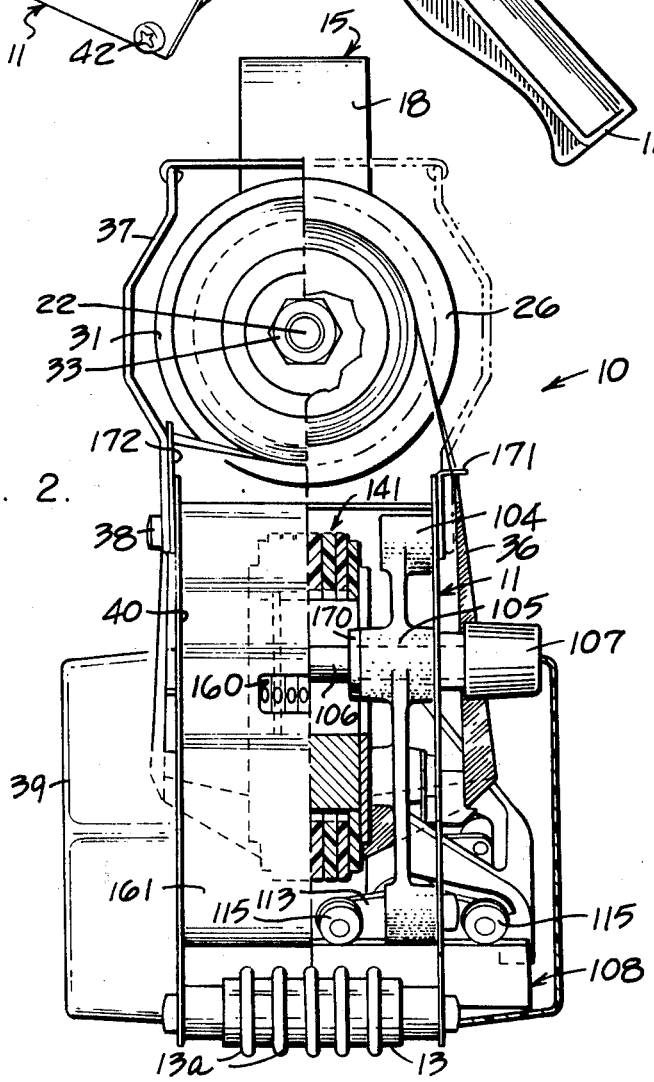
FIG. 2 is a front elevation of the imprinter with parts broken away to illustrate some of its internal mechanisms.

The overall appearance of the lightweight hand-operated imprinter and dispenser unit 10 of this invention can be appreciated by reference to FIGS. 1 and 2. The imprinter generally consists of a rectangular case mechanism or frame 11 having a handle 12 projecting therefrom and a label applicator roller 13 located opposite the handle so that the unit can be manipulated to apply printed labels to an article. Pivoted adjacent to the handle is a trigger lever 14 which can be manually squeezed toward the handle from its ready position, and when released, will return to its ready position due to an internal spring. This manipulation of the trigger lever operates the unit as described hereinafter.

Mounted at the top of the mechanism case 11 is a label stock roll 15 which is supported on projecting support members 16 integrally formed with the handle on D-shaped bosses **16*a* that receive the aperture of label spool 17. The support members bear against the side of the label stock roll, and due to their flexibility, can be spread to remove the empty spool and to insert a new roll of label stock. The label stock itself is a two-layer tape composed of a backing strip 18 and discrete labels 19 serially arranged on the backing strip and adhesively attached thereto, with the backing strip having a silicone or similar release coated surface so that the label will conveniently peel from the backing strip. Compared to the backing strip or tape 18, the label stock is relatively stiff, and therefore, any sharp reversal of the backing strip or tape, such as illustrated adjacent to the applicator roller 13 in FIG. 3, will cause the individual labels to peel from the backing tape. As can be seen in this Figure, the imprinted label 19*a* still has a portion adhered to the backing strip or tape, while the printed surface rests on the plurality of rubber rings 13*a* of the applicator roller. In this position, the label can be "wiped" onto an article to mark it with the imprinted label. Further in FIG. 3,** the actual threading arrangement of the label stock and backing strip or tape is illustrated with a broken line.

Figure 3:
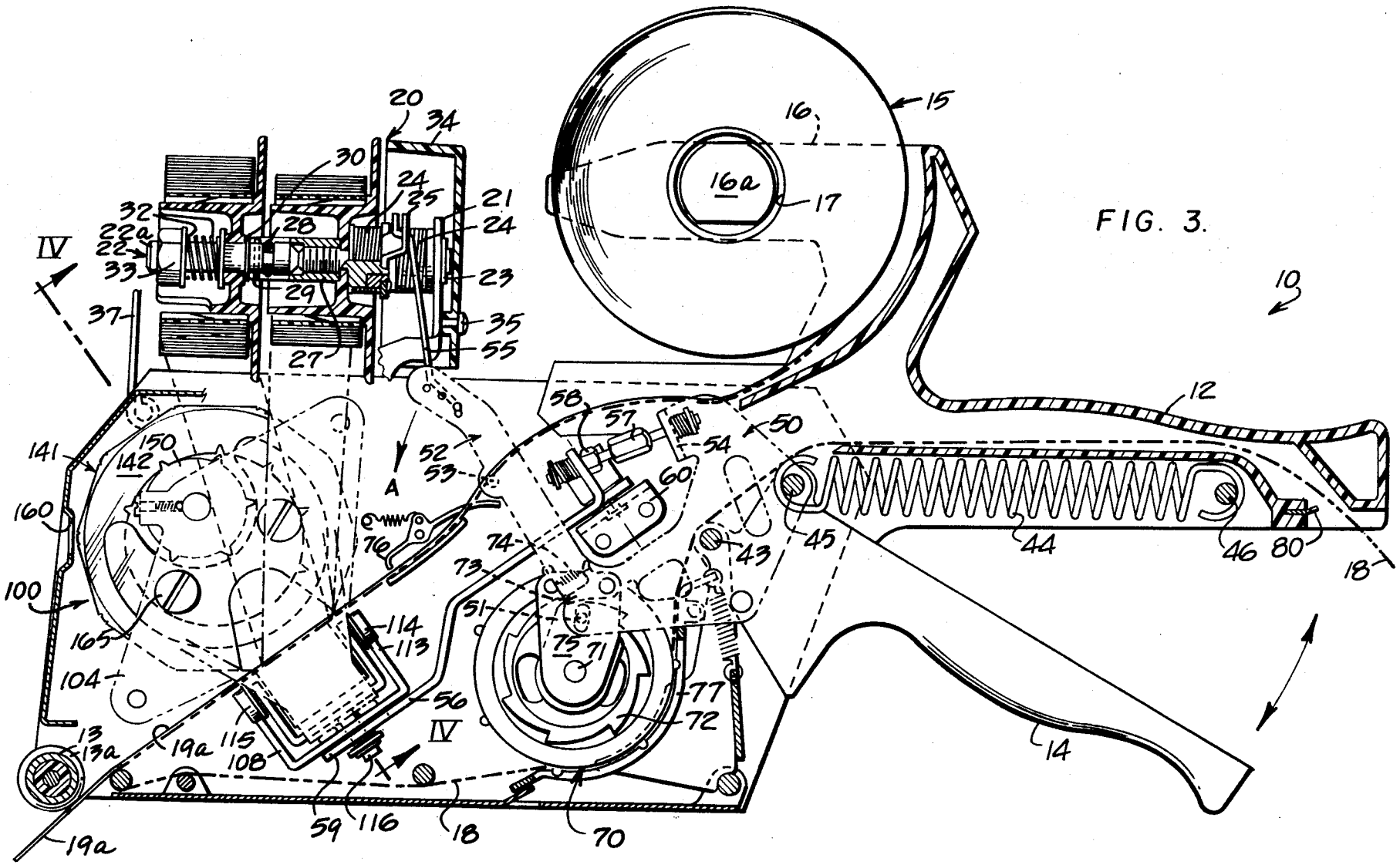
FIG. 3 is a longitudinal section through the imprinter showing the arrangements of parts within its case or frame and employing phantom lines to detail the relationship of some of its parts broken away.

Just forward of the label stock roll 15, also mounted on the top of the mechanism case 11, is the printing medium mechanism 20, which contributes to the compactness of the device as well as achieves other advantages in controlling the printing medium regarding its threading through the imprinter assembly. Basically, this unit is mounted on a bracket 21 which is secured to the mechanism case 11 by bolts or the like. It includes a two-part spindle 22 that has one end journalled in the bracket and retained with a keeper 23, allowing the spindle to rotate. Contiguous to bracket 21 is a one-way spring clutch assembly 24 having an actuator lever or arm 25 projecting therefrom. Connected to the clutch and the spindle is a ribbon take-up spool 26 which is retained in a non-rotating relationship with the clutch and the spindle by a threaded sleeve 27, as can be seen in FIG. 3. The threaded sleeve includes a notch in its end and an internal groove for receiving the outboard end **22*a* of the spindle which includes an O-ring 28 in its inner end which is received in the groove in the sleeve and a transverse pin 29 which is received in the notch or slot in the end of the sleeve. Thus when the outboard end of the spindle is forced into the sleeve, it is retained by the O-ring 28 and is held in a non-rotating relationship by the pin. Just outboard of the end of the sleeve when the spindle is assembled is a washer member 30 which forms an axial stop on the outboard end of the spindle against which the ribbon supply spool 31 abuts when it is assembled on the shaft. On the opposite face of the ribbon supply spool, which is free to rotate on the shaft, is a spring and washer assembly 32 which is retained on the end of the spindle with a nut 33.** This nut is threaded on the end of the spindle and includes a deformable material which engages the threaded end of the spindle to lock the nut into the position selected for the proper frictional drag between the supply spool and the spindle. Since the printing medium is on a ribbon and the supply and take-up spools are mounted on a common spindle, it can be appreciated when the loop of ribbon between these two spools is advanced by the action of the clutch, the spools will counter-rotate. The supply spool counter-rotates on the spindle and as a result of the aforedescribed arrangement, the ribbon is maintained under tension in its threading loop through the imprinter mechanism.

In addition, the above arrangement allows the ribbon supply spool and the outer end of the spindle **22*a* to be snapped outwardly to enable a person to conveniently remove the used ribbon on the take-up spool 26. In this regard, the empty cardboard spool from the supply spool can then be placed on the take-up spool and a new supply of ribbon placed upon the ribbon supply spool 31, whereafter the end of the spindle can be assembled as described above by forcing its end into the threaded sleeve 27. The loop is then threaded through the mechanism and connected to the empty spool on the take-up spool 26. A cover 34 is attached to brackets 21 with a screw 35** to protect the clutch mechanism and also to improve the overall appearance of the unit.

It should be appreciated that this arrangement for the ribbon supply and take-up spools provide considerable convenience for the user of the unit in changing the ribbon 36 which provides the printing medium for the imprinter as well as provides the proper tension on the ribbon through the imprinter assembly and also a transverse feed thereto. Protecting the spools of the printing medium mechanism is a wire guard 37, which is attached with screws 38.

For the convenience of threading ribbon 36 through the imprinter assembly described hereinafter when a new ribbon is threaded in the unit, bubble cover 39 is placed on each side of the mechanism case, as illustrated in FIGS. 1 and 2, and can be removed. These covers can be hinged on the side plates of the mechanism case or frame or alternatively can be retained with spring clips, as desired. In FIG. 7, the actual threading of the ribbon 36 through the imprinter assembly is shown in a schematic fashion.

More specifically, the mechanism case or frame 11 is rectangular in configuration and includes two side plates 40 between which the handle 12 is secured with bolts 41. Likewise, other internal components are retained between the plates with bolts 42 in a similar fashion. In the embodiment illustrated in the drawings, the trigger lever 14 is pivoted on master pivot 43 between these two side plates, and as indicated above, operates the device.

The functions effected by the trigger lever can best be seen in FIG. 3, wherein this lever is illustrated held in its ready position by spring 44 mounted inside handle 12 between a cross pin 45 in the trigger lever and a pin 46 in the outboard end of the handle. It can be appreciated when an operator squeezes the lever toward the handle that spring 44 will be extended, and of course when the handle is released, the trigger lever will return to its ready position illustrated in FIG. 3, due to action of the spring.

The trigger lever controls and times all the functions of the device through an actuator plate 50. This plate is fixedly secured to one side of the trigger lever 14 within the mechanism case and includes a backing strip or tape advancing pin 51, a ribbon advance arm 52, including a brake release pin 53 and a platen drive lug 54 which cooperate with the several other mechanisms in the unit to operate it in a timed relationship.

More specifically, as trigger lever 14 is squeezed into the handle, the ribbon advance arm 52 will move in an arcuate path as indicated by arrow A. As a result of link 55 connecting this arm with the clutch lever 25, the latter will be swung toward the mechanism case. However, since the clutch allows its arm free travel in this direction, the print medium mechanism will not be driven. Obviously the degree of drive of the printing medium mechanism can be controlled by using the several adjusting holes in the end of the ribbon advance lever 52 illustrated in FIG. 3. Since the clutch declutches its lever, the ribbon advance lever moves in the direction of arrow A, but not in the opposite direction, the return of the lever to the ready position will cause the printing medium mechanism to be driven, advancing the ribbon 36 proportionally.

As the trigger lever 14 is squeezed into the handle, the platen drive is actuated through the platen drive lug 54, as indicated above. Basically, this drive is best illustrated in FIGS. 3 and 8, and when referring to the latter Figure, it can be seen that the lug is connected in the platen drive arm 56 through a drive rod 57 that includes an adjusting nut 58 threaded thereon so that the arcuate motion of the bifurcated end 59 of this arm can be controlled. The arm at one end is pivoted in a cross bracket 60 on a pin 61 and retained thereon with a keeper 62. At one side of the arm is an extension and a turned-up lug 63, and thus it can be appreciated that with the drive rod located between the lug on the actuator plate and lug 63, the bifurcated end of this arm will swing in an arcuate path between its initial position shown in FIG. 8 to a similar position adjacent to the opposite side plate and return each time the trigger lever is cycled. The drive rod 57 is retained between the two lugs by its projecting ends, on each of which a spring 64 is retained with a keeper 65. These springs provide lost motion for the bifurcated end 59 of the arm should the platen assembly become caught during its return, thereby avoiding damage to the imprinter mechanism hereinafter described.

Another function accomplished by the actuator plate is the drive of the backing strip or tape which advances the label stock through the imprinting mechanism. This is accomplished through a capstan wheel 70 having a plurality of spaced-apart projections that engage preformed apertures **18*a* in the backing tape to provide a positive drive. This capstan is supported on a shaft 71 extending between the several side plates, and includes a ratchet and pawl arrangement composed of a ratchet wheel 72 and a pawl 73 which is urged against the teeth of the ratchet wheel by a spring 74. The pawl and spring are mounted on a control plate 75 which is journalled on shaft 71 and includes an elongated aperture to receive the backing strip or tape drive pin 55. As a result of this arrangement, as the trigger lever is merged with the handle, the actuator plate will rotate the control plates so that the pawl engages the next tooth of the ratchet wheel 72. As a result, when the handle is released and the control plate is carried back to its initial position by the actuator plate, the capstan will be driven a precise amount, i.e. to advance the label stock one label unit through the imprinter assembly. At the time the capstan drives, the brake release pin 53 has engaged an arm of the clamping brake 76 so that the label stock is free to advance free of resistance from the brake. This arrangement and relationship can be seen in FIG. 3,** illustrating the clamping brake as a member which is urged against a portion of the guide means for the label stock just ahead of the imprinter assembly.

As can be appreciated from the above description, the trigger lever, when merged with the handle, will drive the platen drive arm 56 in one direction, and upon its release, will, under the effect of spring 44, drive this arm in the opposite direction while advancing ribbon 36 to the imprinter assembly and simultaneously advancing the label stock through the imprinter assembly by a precise amount so that a label will be disposed on the applicator roller, as illustrated in FIG. 3. Further, this arrangement allows the imprinter assembly to be located closely adjacent to the applicator roller (see FIG. 3) so that a minimum number of printed labels 19 are in transit between the imprinter and the applicator roller. In the instant situation, only two printed labels **19*a* are in transit, while other devices often have three or more. In order to ensure a positive drive of the backing tape, and thus positive positioning of the label stock in the imprinter assembly so each discrete label will be properly printed, as noted above, the projections on the capstan wheel are received in small apertures 18*a* in the backing strip or tape (see FIG. 7). In addition, a spring-loaded arcuate band 77 including grooves 78 which match the spacings of the projections on the capstan wheel 70 is urged against the outer surface of this wheel to retain the tape therebetween and to ensure that the projections are received in the apertures 18*a*. Spring 79 is assisted by a secondary spring (not shown) on the bottom of the mechanism case that engages the free end of this band when the bottom door of the mechanism case is closed. Further, it can be seen in FIG. 3 that the backing strip or tape is threaded through the handle and egresses near its outboard end adjacent to a serrated edge 80** which can be used to assist in tearing off the end of this backing strip or tape when its length becomes cumbersome to the operator of the unit.

A very important part of the instant unit is the special imprinter assembly 100 which is illustrated in whole or in part in FIGS. 2, 4, 5, 6 and 9, as well as in phantom in FIG. 3. Basically, this assembly or sub-assembly of the unit is composed of two main components, the platen component 101 and the print component 102, which are joined in a unitized assembly with heavy brackets 103 and 104, the latter of which has a bearing 105 for journalling the dial setting shaft 106 driven by dial knob 107. With these two main components joined in this manner, the imprinter assembly can be serviced as a unit, and further, the arrangement allows the platen and print mechanism portions to be accurately positioned and accurately retained relative to one another so that close tolerance label printing with high resolution can be accomplished. This is extremely important in some of the applications of the instant unit, since the data printed generally has a unit width of approximately 0.012 with a tolerance of plus or minus 0.003, and thus, very little tolerance between the several parts can be accepted in the imprinter assembly, which is driven by the bifurcated end 59 of the platen drive arm 56 previously described.

The platen component 101 consists of a rail bed 108 having a large aperture 109 in its base and two upstanding spaced-apart rails 110 and 111 which are parallel to one another. This rail bed is secured to the heavy brackets 103 and 104 respectively at its opposite ends of tap bolts 112. A U-shaped platen carrier 113 which is received on the rail bed, has spaced-apart support wheels 114 aligned along one of its sides, with complementary spaced-apart support wheels 115 aligned along its opposite side, which are received on the top surfaces of the spaced-apart rails when the U-shaped member is inserted into the rail bed in the manner shown in FIG. 4. As can be seen in this latter figure, the projecting pin 116 on the bottom of the U-shaped member is received in the aperture 109 and extends below the rail bed, where it is connected to the bifurcated end 59 of the platen drive arm 56 and retained thereon with a spring 117, a washer 118 and a keeper 119, which is received in the groove near the distal end of pin 116. This spring, when compressed, holds the rollers 114 and 115 against the respective rails 110 and 111. As can be seen in FIG. 4, the U-shaped carrier 113 is cycled from the position illustrated, in the direction of arrow B, to the position illustrated in phantom adjacent to bracket 103, where an adjustable stop 120 is engaged by the carrier. When the carrier returns to its initial position adjacent to bracket 104, a similar adjustable stop 121 controls its position. It can be appreciated that these several stops can be adjusted to achieve the proper travel of this carrier member. While the mechanism described uses rectilinear motion, the rails could be curved and the path of the carrier arcuate.

The imprinting function is accomplished when the carrier moves from the position illustrated in FIG. 4 to the position adjacent to bracket 103 illustrated in phantom, during which time the platen surface 125 is pressed against the planar print surface 126 sandwiching the ribbon 36 containing the printing medium and the label stock against the characters or fonts on the several print wheels, which have their characters or fonts aligned in the planar printing surface. Usually, the platen surface is formed of a cylindrical resilient sleeve, so that the necessary imprinting pressures can be developed when the print surface is slightly uneven. This also helps to avoid damage to the character or font on the several wheels.

Figures 9, 10, 11:
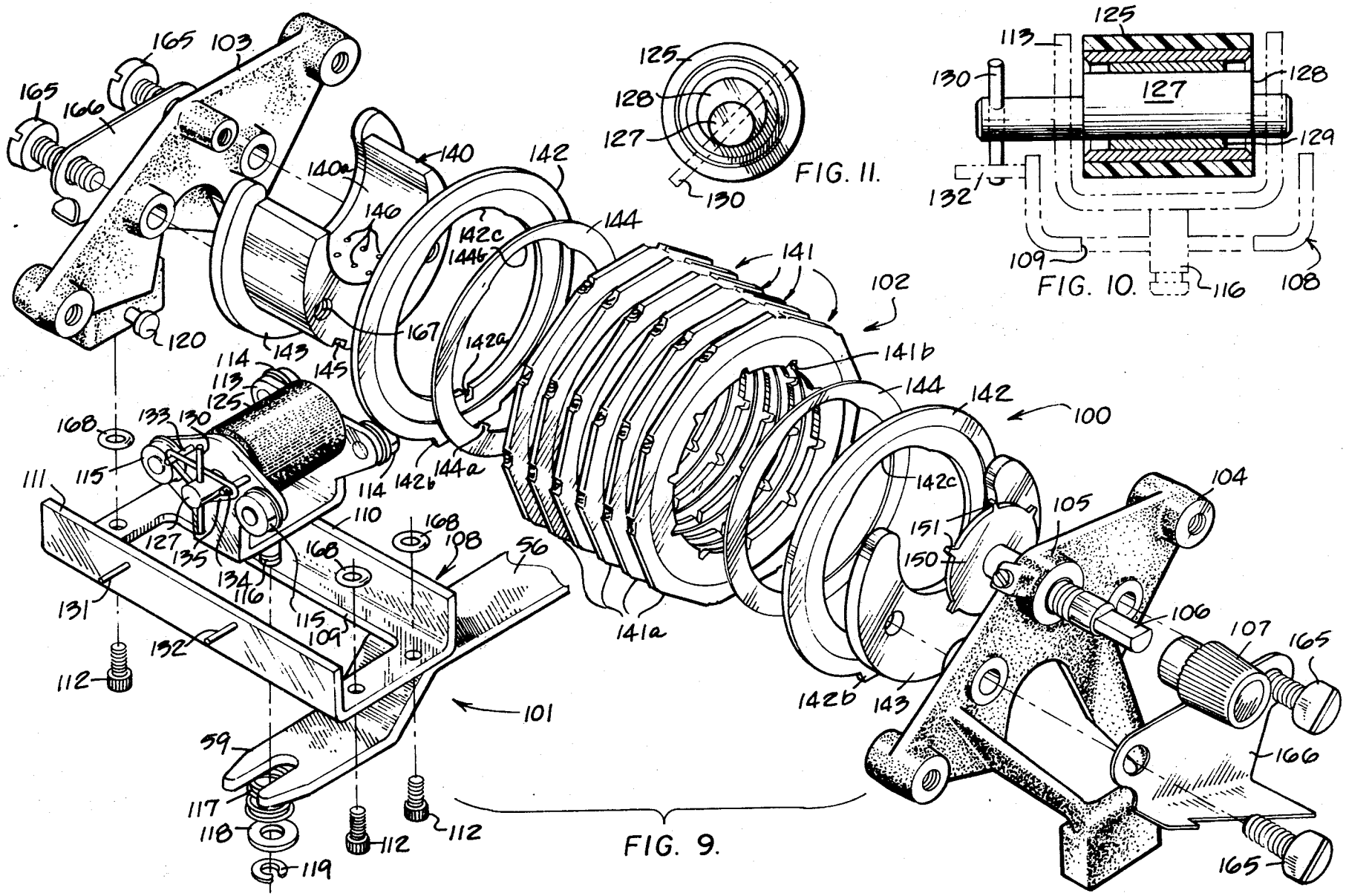
FIG. 9 is an exploded perspective of the imprinter assembly showing its components for achieving high resolution printing.
FIG. 10 is a section through the cylindrical platen or roller showing its eccentric shaft and parts of the platen components in phantom.
FIG. 11 is an end elevation of the cylindrical platen or roller removed from the platen component.

As indicated above, the platen surface or roller accomplishes the imprinting function as it moves toward bracket 103. However, it has also been indicated that upon the return of the trigger lever to the ready position 14 illustrated in FIG. 1, that the label stock and the ribbon 36 are advanced. Thus when this occurs, it is necessary that the platen surface not engage the planar print surface 126. To achieve this end, the mounting of the platen surface within the U-shaped carrier 113 is specially constructed, employing an eccentric shaft 127 which is best illustrated in FIGS. 10 and 11. This shaft is journalled in the U-shaped carrier so that its central eccentric portion 128 forms the bearing surface for the platen roller, which is journalled thereon with bearing 129, as can best be seen in FIG. 10. Thus, rotation of the eccentric shaft will effectively raise and lower the platen surface so that in one direction, it can be arranged to engage the planar print surface 126, and upon the return direction of the carrier, this surface will be separated from this print surface. The mechanisms to control the position of the platen surface are best illustrated in FIG. 9, wherein it can be seen that the projecting end of eccentric shaft 127 includes a transverse pin 130, which is long enough to engage respectively stop pins 131 and 132 projecting from rail 111. In addition, the vertical surface of the U-shaped carrier 113 also includes several stops 133 and 134, which can be engaged by the opposite end of transverse pin 130. As a result, as the carrier moves to the position illustrated in FIG. 4, the lower end of transverse pin 130 will engage stop pin 132, rotating its top end against stop pin 134 on the platen carrier. In this position, illustrated in FIG. 11, the platen surface is in the raised position, and will engage the planar print surface when the carrier moves toward bracket 103. As the carrier assumes the position shown in phantom in FIG. 4, the lower end of the transverse pin will engage stop pin 131, rotating eccentric shaft 127 in a direction to cause the top end of this transverse pin to engage stop pin 133 on the platen carrier, lowering the platen surface for the return of the carrier to its initial position. As can be seen in FIG. 9, a rubber O-ring 135 is stretched between the eccentric shaft 127 and stop pins 133 and 134 on the carrier. This O-ring acts as a snubber to prevent the eccentric shaft from rotating due to vibrations when it reciprocates on the rail bed.

A very important part of the imprinter assembly is the print components 102, which have a relatively unique construction, enabling the use of plastic characters or fonts on the several print wheels without loss of resolution in the printed label. This structure is best illustrated in FIG. 9. It includes a large diameter crescent-shaped print shaft 140 that provides a large bearing surface for a plurality of adjustable print wheels 141 as well as two stationary print wheels 142 which are assembled axially on the print shaft in parallel abutting relationship with the stationary wheels on the outer sides of the resulting sandwich of wheels. The stationary print wheels illustrated are non-adjustable types, but could be replaced with adjustable print wheels if desired. However, in some versions of the UPC code, certain codes are mandatory which can be accomplished with the stationary print wheels. In the instant embodiment, the stationary print wheels 142 include a location notch **142*a* which is received on a pin (not shown) on the print shaft to properly locate its printing font 142*b* in the planar print surface. In addition, each stationary wheel includes a small lobe 142c** in its inner periphery so the internal dialing mechanism will not engage the stationary wheel.

As can be seen in FIG. 9, the crescent-shaped print shaft 140 includes an enlarged side support plate 143 at both of its ends (also crescent-shaped) that forms a rim or flange about each end of the print shaft. This rim or flange provides support for the printing font of the stationary wheels and the other print wheels which bear against the stationary wheels, so that lateral deflection will be limited when the platen surface tracks across the several fonts in the planar print surface 126. In sequential assembly on the print shaft, as illustrated in FIG. 9, a stationary print wheel is first assembled directly against the rim formed by the side support plate. It is oriented so that the stationary pin in the print shaft (not shown) is received in notch 142 so that its flat printing font is properly oriented in the planar print surface. Thereafter, a thin washer member 144 is assembled on the print shaft so that its tab key 144a is received in an axial groove 145 in the print shaft to prevent rotation of this washer or spacer. As illustrated, the stationary and also the adjustable print wheels may include a relief so that the spacing between the several characters or fonts can be kept to an absolute minimum, while still providing a stationary bearing surface between adjacent rotating wheels. This prevents contiguous wheels from turning when a print wheel is adjusted. Each washer includes an additional lobe 144b in its inner periphery to avoid interference with the internal print wheel adjusting mechanism described hereinafter.

After the first stationary print wheel 142 has been assembled, followed by the keyed washer 144, and adjustable print wheel 141 is assembled on the print shaft. Subsequently, another washer and another print wheel are axially assembled on the print shaft, until the desired number of adjustable print wheels is assembled thereon. Thereafter, one additional washer or spacer 144 is assembled thereon and the final stationary print wheel 142 is assembled, followed by the addition of a side support plate 143. The length of the axial shaft is carefully controlled so that the resulting assembly forms a precision imprinting assembly when the fonts of the stationary print wheels and the adjustable print wheels are properly aligned in the planar print surface. Through the use of a large diameter print shaft and the side plates at its opposite ends, it is possible to use plastic print wheels, since two advantages are obtained, in that the radial section shrinkage of the several print wheels is not great and the fonts are supported close to the planar print surface so that close tolerances can be maintained. In addition, the lateral deflection of these wheels can be more precisely controlled by the side plates in this design. Even though the inner diameter of the wheels cannot be controlled precisely, the crescent-shaped print shaft allows the wheels to be fitted to the print shaft, since the cut-out crescent-shaped portion allows adequate clearance for a closely controlled fit therebetween adjacent to the print surface.

Each of the print wheels 141 in the assembly has an outer polygonal configuration with each of the flat surfaces 141a having a character or font which can be aligned in planar printing surface 126 for imprinting a label with the desired information, such as a UPC code. The inner circular diameter of each of these adjustable print wheels 141 includes a series of notches 141b through which adjustment can be achieved and position correspondence of the several fonts can be maintained in the planar printing surface. Position correspondence in the planar printing surface is maintained by a plurality of ball detent means 146 drilled in the print shaft which include a spring 147 and a ball 148 which is urged outwardly by the spring to engage the notches 141b in the inner diameter of the adjustable print wheels. As can be seen in FIG. 4 and FIG. 9, these notches in the print wheels are evenly spaced, and thus can be brought into engagement with the balls when a particular font is properly aligned in the planar print surface. In order to provide adequate room for these ball detent devices, every other one is offset by a notch; however, this does not change their operation.

As indicated above, one of the objectives of the instant invention is to develop a hand-held labeler which can maintain the character-to-character limitations and tolerances required by the UPC. In order to accomplish this in a hand-held imprinter, the spacings between adjacent print wheels must be kept to an absolute minimum, and this raises difficulties in adjusting the several print wheels. However, in the instant invention, it is possible to adjust the print wheels through an internal gearing arrangement, using notches 141b in the adjustable print wheels 141. This arrangement is best illustrated in FIGS. 5 and 6, wherein it can be seen that a spur gear 150 having a minimum number of teeth 151, is assembled on the inboard end of shaft 106 so that it can be turned by knob 107. Spur gear 150 is relatively narrow or thin so that its teeth 151 can only engage a single print wheel at one time. In addition, the shaft 106 includes a plurality of grooves 106a which cooperate with the ball detent mechanism 152 including a spring 153 and a ball 154 which are mounted in a radial bore in the journal or shaft 106. The ball will be received in one of the grooves 106a when the spur gear is properly in line with one of the adjustable print wheels. As a result of this arrrangement and the spacing on the sprocket teeth, it is possible through knob 107 to dial the information on print wheels 141 so that the proper font or character can be positioned in the planar print surface. This facilitates the construction of a hand-held label unit wherein the maximum amount of code settings can be achieved without degradation of the imprinted information.

As can be seen in FIG. 2, the readable codes of the several adjustable print wheels can be seen in a small window 160 in the front plate 161 of the mechanism case. In general, the operator should refer to the alignment of the several code indications in this window to ensure that the several characters or fonts of the print wheels are properly aligned on the print surface, even though the detent mechanism should ensure that these are properly aligned.

The crescent-shaped print shaft 140 allows the imprinter component to be rigidly attached in the imprinter assembly with bolts 165, which also retain the ribbon guides 166 on the outer faces of brackets 103 and 104 when the bolts are tightened in the threaded bores 167 in the opposite ends of the print shaft. When so assembled, the large arcuate groove 140a receives the sprocket 150 that can be rotated in this groove, and of course, when meshed with a notch 141b in one of the print wheels, will cause the latter to rotate when the dial shaft 106 is turned.

It is sometimes desirable to use spacers 168, which can be constructed of resilient material, between the rail bed 108 and its connections to the end of brackets 103 and 104. This provides an adjustment arrangement for achieving the desired engagement pressure between the platen surface and the planar print surface 126.

In certain embodiments of the unit, the readable numeral adjacent to each font or character on print wheels 141 that appears in window 160 can be colored to indicate that an operator has dialed an invalid code for a specific code type. Further, certain portions of the code can be fixed by pinning an adjustable print wheel in the same manner that the stationary print wheels 142 are locked on the print shaft. Obviously when this is done, it is desirable to remove enough of the inner top diameter of the wheel so it will not mesh with spur gear 150. Also, additional spacers 170 can prevent changing the adjustable print wheel 141 at either end of the stack (see FIGS. 5 and 6).

As can be seen in FIG. 3, the imprinter sub-assembly is mounted between side plates 40 very close to the applicator roller 13 to minimize the number of printed labels in transit. The printing medium mechanism 20 of course facilitates this mounting, since it minimizes ribbon interference with the imprinter and label feed.

Strippers (not shown) may be incorporated on the bottom door of the mechanism case to prevent a printed label from fouling the capstan roller 70 should it not properly peel from the backing tape. In addition, ribbon guides 171 and 172 are usually attached to the top of the mechanism case to guide the ribbon to and from the imprinter assembly, as can be seen in FIGS. 1, 2 and 7.

Having described our invention, we claim:

1. A hand-held precision label printer/dispenser comprising:

a case mechanism having a handle extending therefrom and an applicator means mounted in said case remote from said handle;

a lever means pivotally mounted adjacent to said handle for manually operating the printer;

slide means mounted in said case having a carrier mounted thereon for reciprocal movement, said carrier having a platen surface associated therewith;

planar print surface means mounted in said mechanism case adjacent to said carrier and engageable by said platen surface;

control means associated with said carrier and said planar print surface operable to cause said platen surface to engage said planar print surface means and separate therefrom;

linkage means interconnecting said lever means with said carrier and operable to move said carrier from its initial position in which said control means has positioned the platen surface for engagement with said planar print surface means to a second position wherein the control means will separate said platen surface from said planar print surface means whereby said planar surface will not engage said planar print surface means when it returns to its first position;

printing medium feed means and label stock feed means oriented normal to another and operable to place said printing medium and label stock in contiguous relationship with said printing surface whereby said platen surface will imprint the data on said planar print surface means on said label when the carrier moves from said initial position to said second position and said label stock feed means and printing medium feed means can advance when said carrier returns from said second position to its initial position due to the separation between said platen surface and said planar print surface means;

feed linkage means interconnecting said lever means with said printing medium feed means and said label stock feed means operable to advance said label stock feed means and said printing medium feed means as said carrier returns from such second position to its initial position; and said printing medium means having supply and takeup spools coaxially mounted with spindle units on a common spindle, said common spindle having a one-way clutch connected to said feed linkage means whereby a loop of ribbon between said spools mounted on said spindle units is advanced by said feed linkage means, with one of said spindle units being operatively retained by detent means whereby it can be removed to facilitate loading new spools and removing old spools containing said ribbon providing the printing medium.

2. The device defined in claim 1 wherein the ribbon supply spool includes frictional means on said spindle operable to allow said supply spool to counter-rotate when the take-up spool rotates with the spindle.

3. The device defined in claim 1 wherein the label stock feed means includes a capstan wheel means having a ratchet assembly connected to the feed linkage means whereby said capstan wheel means can advance the label stock during the time the carrier returns from its second position to its initial position, and said ratchet means will be inoperative to advance the label stock when said carrier moves from its initial position to said second position.

4. The device defined in claim 3 wherein the capstan wheel means includes projections which positively engage pre-formed apertures in the backing tape of a label stock feed to ensure positive drive thereof.

5. The device defined in claim 4 wherein said capstan wheel includes an arcuate band having slots spaced therein to match said projections on said capstan wheel and biasing means urging said arcuate band against said capstan wheel whereby said projections will be positively engaged with the pre-formed apertures in said backing tape.

6. The device defined in claim 1 wherein the label stock feed means includes a brake operable to engage label stock therein and connected to said feed linkage means whereby said brake will release when said carrier returns from said second position to its initial position.

7. The device defined in claim 1 wherein the platen surface is resilient.

8. The device defined in claim 1 wherein the control means includes spaced-apart stop pins means on the carrier and the slide means, and the shaft contains a transverse pin engageable by said stop means which are operable to raise and lower said platen surface when said transverse pin engages said stop pin means due to the reciprocal movement of said carrier.

9. The device defined in claim 1 wherein the slide means are oriented normal to the handle and the linkage means includes a pivoted arm connected to the lever means which is driven by said lever to swing the end of said pivoted arm in a reciprocal arcuate path, said end of said arm connected to said carrier to move the latter from its initial position to its second position and return it to said initial position.

10. The device defined in claim 9 wherein the detent means includes a plurality of ball-spring means, said ball-spring means operable to engage a recess in a print wheel when any of the printing fonts of its associated print wheel is properly positioned in the rectangular print surface.

11. The device defined in claim 1 wherein the slide means includes a pair of spaced-apart rails and the carrier includes a plurality of wheels in engagement with said rails.

12. The device defined in claim 1 wherein the printing medium feed means includes a spindle with a take-up spool mounted thereon and a supply spool coaxially mounted thereon and guide means whereby a loop of ribbon on said spools can be threaded across the planar print surface means parallel to the slide means and said label stock feed means includes guide means feeding said label stock across said planar print surface means normal to said loop of ribbon.

13. The device defined in claim 1 wherein the planar print surface means is composed of a plurality of elongated print characters, each of which print characters are formed on an outer flat periphery of a polygonal print wheel means, said print wheels being mounted in axially abutting relationship on a common print shaft and including internal gear means whereby the characters in said flat print surface means can be selected from any of the characters on the outer periphery of said print wheel means.

14. The device defined in claim 13 wherein the inner periphery of each of said print wheel means includes a plurality of notches and said print shaft includes detent means operable to engage one of said notches when the elongated print surface of its associated wheel is aligned in said planar print surface means.

15. The device defined in claim 14 wherein the internal gear means includes a spur gear arranged to operably engage the notches in each gear wheel when said spur gear is aligned therewith, said spur gear being mounted on an axially locatable shaft whereby rotation of the latter can individually change the particular character of the print wheel means with which the spur gear is engaged.

16. The device defined in claim 15 wherein each print wheel means has a plurality of elongated character fonts on its several flat surfaces and a radial section beneath each character is of a radial thickness less than the length of any elongated character font on its plurality of flat surfaces and the print shaft includes a large semi-circular boss oriented to support its characters in the planar print surface means.

17. The device defined in claim 16 wherein the print shaft includes flange means at its opposite ends operable to laterally support the several print wheels axially mounted on the print shaft.

18. The device defined in claim 1 wherein the platen surface is a cylindrical surface mounted for rotation on a shaft supporting said cylindrical platen surface with the control means connected to said shaft whereby said shaft can be rotated to cause the platen surface to engage the planar print surface means when the carrier moves from its initial position to its second position, and said shaft can be rotated in the opposite direction to separate said cylindrical platen surface from said planar print surface means when said carrier moves from said second position to its initial position.

* * * * *